US007246970B2

(12) United States Patent
Hey

(10) Patent No.: US 7,246,970 B2
(45) Date of Patent: Jul. 24, 2007

(54) SHALLOW WATER WATERCRAFT LIFT

(75) Inventor: Kenneth E. Hey, Mercer Island, WA (US)

(73) Assignee: Sunstream Corporation, Kent, WA (US)

( * ) Notice: Subject to any disclaimer, the term of this patent is extended or adjusted under 35 U.S.C. 154(b) by 79 days.

(21) Appl. No.: 11/258,400

(22) Filed: Oct. 24, 2005

(65) Prior Publication Data

US 2006/0147268 A1 Jul. 6, 2006

Related U.S. Application Data

(60) Provisional application No. 60/621,520, filed on Oct. 25, 2004.

(51) Int. Cl.
*B63C 3/06* (2006.01)

(52) U.S. Cl. ..... 405/3; 114/44; 414/678

(58) Field of Classification Search ..... 405/3, 405/1, 7; 414/678; 114/44, 48
See application file for complete search history.

(56) References Cited

U.S. PATENT DOCUMENTS 4,072,119 A * 2/1978 Williams ..... 405/3
4,850,741 A * 7/1989 Timmerman ..... 405/3
5,184,914 A * 2/1993 Basta ..... 405/3
5,275,505 A * 1/1994 Wilcox ..... 405/3
5,449,247 A * 9/1995 Smith ..... 405/3
5,890,835 A * 4/1999 Basta et al. ..... 405/3
5,908,264 A * 6/1999 Hey ..... 405/3
6,318,929 B1 * 11/2001 Basta ..... 405/3
6,490,987 B1 * 12/2002 Crifase et al. ..... 405/3
6,554,533 B2 * 4/2003 Godbersen ..... 405/3
6,575,661 B1 * 6/2003 Phillips et al. ..... 405/3
6,584,922 B1 * 7/2003 Fritz et al. ..... 405/3
6,830,002 B1 * 12/2004 Walker ..... 405/3
6,830,410 B2 * 12/2004 Davidson et al. ..... 405/3
6,837,651 B1 * 1/2005 Basta ..... 405/3
6,976,442 B2 * 12/2005 Hey et al. ..... 405/3
7,021,861 B2 * 4/2006 Basta ..... 405/3

* cited by examiner

*Primary Examiner*—Frederick L. Lagman
(74) *Attorney, Agent, or Firm*—George C. Rondeau, Jr.; Davis Wright Tremaine LLP

(57) ABSTRACT

A watercraft lift with translating bunks supported by a base frame and having rollers mounted to the base frame to initially raises the watercraft upward when driven onto the lift sufficiently to be positioned above the bunks when in their lowered position and thereby permit operation of the lift in water too shallow for use of the bunks by themselves. The rollers are positioned relative to the translating bunks such that when the bunks are in their lowered position and the lift is used in sufficiently shallow water, the watercraft driven onto the lift initially engages the rollers, which lift the watercraft upward above the height when floating in the water and above the height of the bunks. The translating bunks are then used to lift the watercraft off of the rollers and upward to a raised position above the water.

29 Claims, 11 Drawing Sheets

SHALLOW WATER WATERCRAFT LIFT

CROSS REFERENCE TO RELATED APPLICATION

This application claims priority benefit of provisional application Ser. No. 60/621,520 filed Oct. 25, 2004.

FIELD OF THE INVENTION

The invention generally relates to a watercraft lift which reduces the minimum water depth requirement for free-standing boat lifts.

BACKGROUND OF THE INVENTION

The use of watercraft lifting devices is well known. A watercraft may be subject to several difficulties if moored within the water: damage to the watercraft may occur when wave action or other in-water forces cause the hull of the watercraft to strike adjacent in-water structures such as docks or seawalls; damage may also result from longer term effects such as vegetative buildup on the hull of the watercraft. Watercraft lifting devices alleviate these potential hazards by allowing the watercraft user to lift the watercraft from a position in the water to a position where the watercraft is wholly above the water. The watercraft lift thus provides a convenient solution to the before-stated difficulties since the watercraft may be quickly removed from the water during periods of non-use and returned to the water when desired with minimal user effort.

Existing watercraft lifts, however, do not sufficiently address problems caused by fluctuating water levels and/or consistently shallow waters. In water bodies where watercraft are typically used, water levels may fluctuate dramatically on a daily or seasonal basis due to tides, weather-related draught or flooding, or because of public or private use of water from reservoirs or lakes. Watercraft moorage facilities may also be situated in waters that are continually shallow. 'Drive-on' style lifts have very little lifting range. Lifts with translating bunks provide adequate range, but do not function in extreme shallow water. Existing translating bunk watercraft lifts may become functionally useless when water levels drop below a certain point. This occurs when the watercraft support platform, typically consisting of supporting bunks, is sufficiently high in the lowered position relative to the watercraft and waterline that friction forces between the watercraft and support platform cause watercraft ingress or egress to become impossible or unsafe.

Generally, watercraft lifts do not employ specific features that allow the lifts to operate in extreme shallow water. U.S. Pat. No. 5,908,264 to Hey and U.S. Pat. No. 518,914 to Basta disclose free-standing boat lifts with translating bunks that operate in this a manner. Since lifts are typically used along the shoreline, water depth has limited use of free-standing lifts for many locations. Certain existing watercraft lifts, however, attempt to address the above issues by using roller devices as the primary watercraft support platform. These watercraft lifts, however, are generally not as desirable due to limitations in lifting range, and that they require means to keep the boat from rolling off the bunks.

U.S. Pat. No. 6,006,687 to Hillman and Vierus employs rollers to allow a watercraft to enter and exit a channel within a modular floating system. This device, however, is limited in that the watercraft can be loaded on the lift smoothly, since the rollers need to be positioned high enough to lift the hull out of the water. The geometry lifts the front of the boat to approximately 30 degrees, which is widely considered to be undesirable to the user. Larger watercraft will require larger modular floating units that, in turn, will increase the minimum water level at which the lift will function properly. In addition, consumers on bodies of water that do not fluctuate much prefer using a freestanding lift, to eliminate effects from waves.

Two known devices use rollers to facilitate watercraft movement up a slope and out of the water. U.S. Pat. No. 5,499,247 to Smith discloses a watercraft lift with two stable rear legs and a front leg that is adjustable. Roller devices positioned on a central support beam are used to support the watercraft and to facilitate ingress and egress. The front of the boat is pulled on the lift using a winch. The watercraft needs to be stored with a front hook, to prevent the watercraft from accidental re-launching. This device is limited, since it requires a person connect the winch to the front of the boat, and winch the boat on the lift. This typically requires the user to disembark from the boat, which is undesirable. Similarly, the lifting height range of this device is limited, so the watercraft may remain subject to damage from moderate wave action or other perils meant to be avoided by the use of a watercraft lift. U.S. Pat. No. 6,520,728 to Schwitters is similar to Smith, but has the additional feature that allows the user to power on the lift without attaching the front of the boat to the winch. This invention also fails to address watercraft protection issues in that the aft portion of the watercraft is not significantly lifted from the water and may remain subject to damage from wave action as a result. Not lifting the rear of the boat from the water is undesirable, since most boat engines are in the rear. Again, relatively steep slope angles may cause additional operator difficulties when attempting to use the watercraft.

Accordingly, there is a need in the art for an apparatus that can convert existing free-standing translating bunks boat lifts for use in shallow water to get the benefit of sufficient lifting range, with the ability to be used in most locations.

SUMMARY OF THE INVENTION

This summary of the invention section is intended to introduce the reader to aspects of the invention and is not a complete description of the invention. Particular aspects of the invention will be pointed out in claims submitted at a later date; such claims alone will demarcate the scope of the invention.

The present invention is generally directed to an apparatus and method for reducing the amount of water depth required for free-standing translating bunk and other boat cradling type boat and other watercraft lifts. More particularly, it relates to an apparatus that lifts the boat a few inches by employing rollers or other initial lift members, thereby facilitating the use of watercraft lifts in shallow waters while maintaining the benefits of a fully functional watercraft lift while also employing a lifting structure that is independent from the rollers, thereby eliminating the need to secure the watercraft on the lift.

The general design of the watercraft lift will determine the efficacy of the invention and thus a basic statement of required lift design attributes is warranted. As will be seen, the ability of the roller apparatus to provide improved watercraft ingress and egress capabilities in shallow waters while also allowing desired watercraft protection is contingent upon the use of the rollers as an initial lifting device and not as the primary means to support the watercraft in its fully lifted state. This not only allows for greatly increased lifting range, but it provides better support for the boat hull. The functionality of the invention will also depend on the watercraft lift's ability to raise the watercraft by means independent from the watercraft's own power. The invention will thus relate primarily to watercraft lifts such as that described in U.S. Pat. No. 5,908,264 to Hey that describes a watercraft lift wherein the watercraft cradle is mechanically raised from a lowered position to a higher raised position and remains relatively horizontal relative to the waterline.

In one aspect of the invention, the shallow water roller apparatus consists of front and rear roller assemblies employing a plurality of marine rollers. Other initial lifting device can be used with or in replacement of the roller assemblies. The illustrated embodiment of the invention uses front and rear roller assemblies. However, the invention will function with any number of rollers, since the boat can be stabilized by the lifting bunks.

In one embodiment the invention comprises a watercraft lift for lifting a watercraft upward, where the watercraft has a first watercraft elevational position when floating in the water prior to engagement with the lift. The lift includes a translating watercraft support movable between a lowered translating support position and a raised translating support position, the translating watercraft support being arranged to engage and lift the watercraft when positioned thereon; and at least one watercraft initial lift member positioned to engage and lift the watercraft to a second watercraft elevational position higher than the first watercraft elevational position as the watercraft is moved into engagement therewith and into a position over the translating watercraft support permitting lifting by the translating watercraft support when in the lowered translating support position, the translating watercraft support being arranged to lift the watercraft off of the watercraft initial lift member and move the watercraft upward to a third watercraft elevational position higher than the second watercraft elevational position as the translating watercraft support moves upward from the lowered translating support position to the raised translating bunk position.

In another aspect of the invention, a method is described for bunking a watercraft in a position above the water using a watercraft lift where the watercraft has a first watercraft elevational position when floating in the water prior to engagement with the lift, and the lift has a translating watercraft support sized to support the watercraft thereon and a watercraft initial lift positioned to engage and lift the watercraft as the watercraft is moved into engagement therewith and into position over the translating watercraft support for lifting by the translating watercraft support. The method includes first moving the watercraft into engagement with the watercraft initial lift with sufficient force to lift the watercraft to a second watercraft elevational position higher than the first watercraft elevational position and position the watercraft for engagement with the translating watercraft support; second moving the translating watercraft support upward from a lowered translating support position to lift the watercraft upward off of the watercraft initial lift; and third moving the translating watercraft support further upward to a raised translating support position whereat the watercraft is in a third watercraft elevational position higher than the second watercraft elevational position.

Yet another aspect of the invention is a method of converting an existing watercraft lift usable to lift a watercraft in water of a first minimum depth to a modified watercraft lift usable to lift the watercraft in water of a second minimum depth less than the first minimum depth, where the watercraft has a first watercraft elevational position when floating in the water prior to engagement with the lift and where the watercraft lift being converted has a translating watercraft support sized to support the watercraft thereon and movable between a lowered translating support position and a raised translating support position. The method includes providing at least one watercraft initial lift; and attaching the watercraft initial lift to the existing watercraft lift in position to be engaged by and lift the watercraft to a second watercraft elevational position higher than the first watercraft elevational position as the watercraft is moved into engagement therewith and over the translating watercraft support for engagement thereby for lifting of the watercraft off of the watercraft initial lift as the translating watercraft support is moved upward from the lowered translating bunk position to the raised translating bunk position whereat the watercraft is in a third watercraft elevational position higher than the second watercraft elevational position. In this method of converting, the watercraft initial lift may include first and second watercraft initial lift members, and attaching the watercraft initial lift may include attaching the first watercraft initial lift member in a position to first engage and lift the watercraft upon the watercraft first being moved onto the lift, and attaching the second watercraft lift member in a position spaced apart from the first watercraft initial lift member to engage the watercraft after the watercraft is first engaged by the first watercraft initial lift member, with the first and second watercraft initial lift members being arranged to support the watercraft positioned thereon at the second watercraft elevational position without requiring securing of the watercraft to the lift.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, which are schematic, and not to scale, wherein.

DETAILED DESCRIPTION OF THE PREFERRED EMBODIMENT

This description illustrates aspects of the invention, and describes embodiments of the invention. This description is not intended to be exhaustive, but rather to inform and teach the person of skill in the art who will come to appreciate more fully other aspects, equivalents, and possibilities presented by the invention. The scope of the invention is set forth in the claims, which alone limit its scope.

The embodiments are set forth in the following description and in FIGS. 1 through 12. One skilled in the art will understand that the present invention may be practiced without using all of the details described herein. In the following description, it is understood that a watercraft includes any vehicle that is at least partially waterborne, including boats and similar vessels, but may also include amphibious vehicles, including various amphibious automobiles or aircraft. Moreover, in the description that follows, it is understood that the figures related to the various embodiments are not to be interpreted as conveying any specific or relative physical dimension, and that specific or relative dimensions related to the various embodiments, if stated, are not be considered limiting unless recited in the claims.

Figure 1:
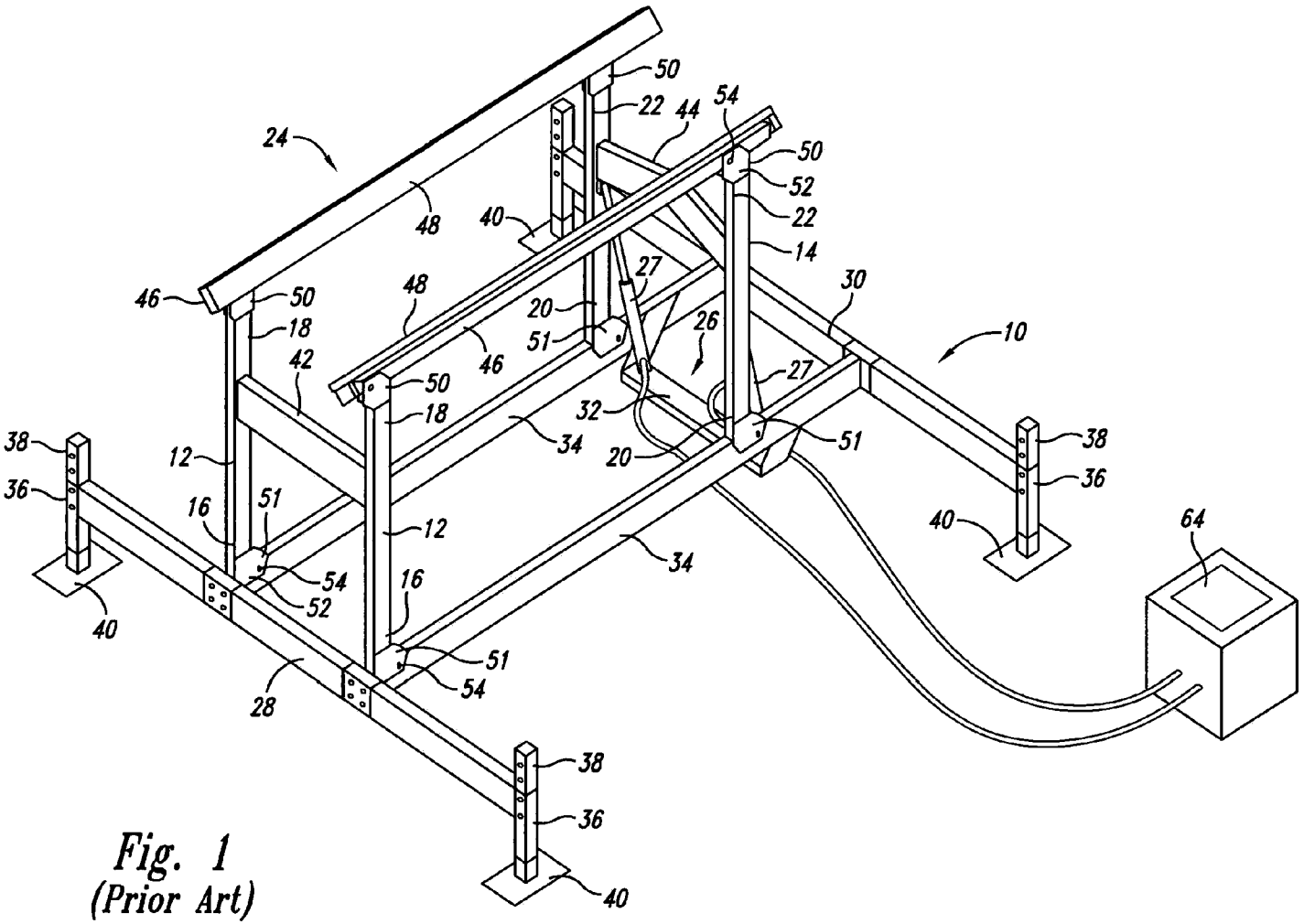
Fig. 1 (Prior Art)
FIG. 1 is an isometric view of a watercraft lift in the "watercraft up" position according to the prior art.
Figure 2:
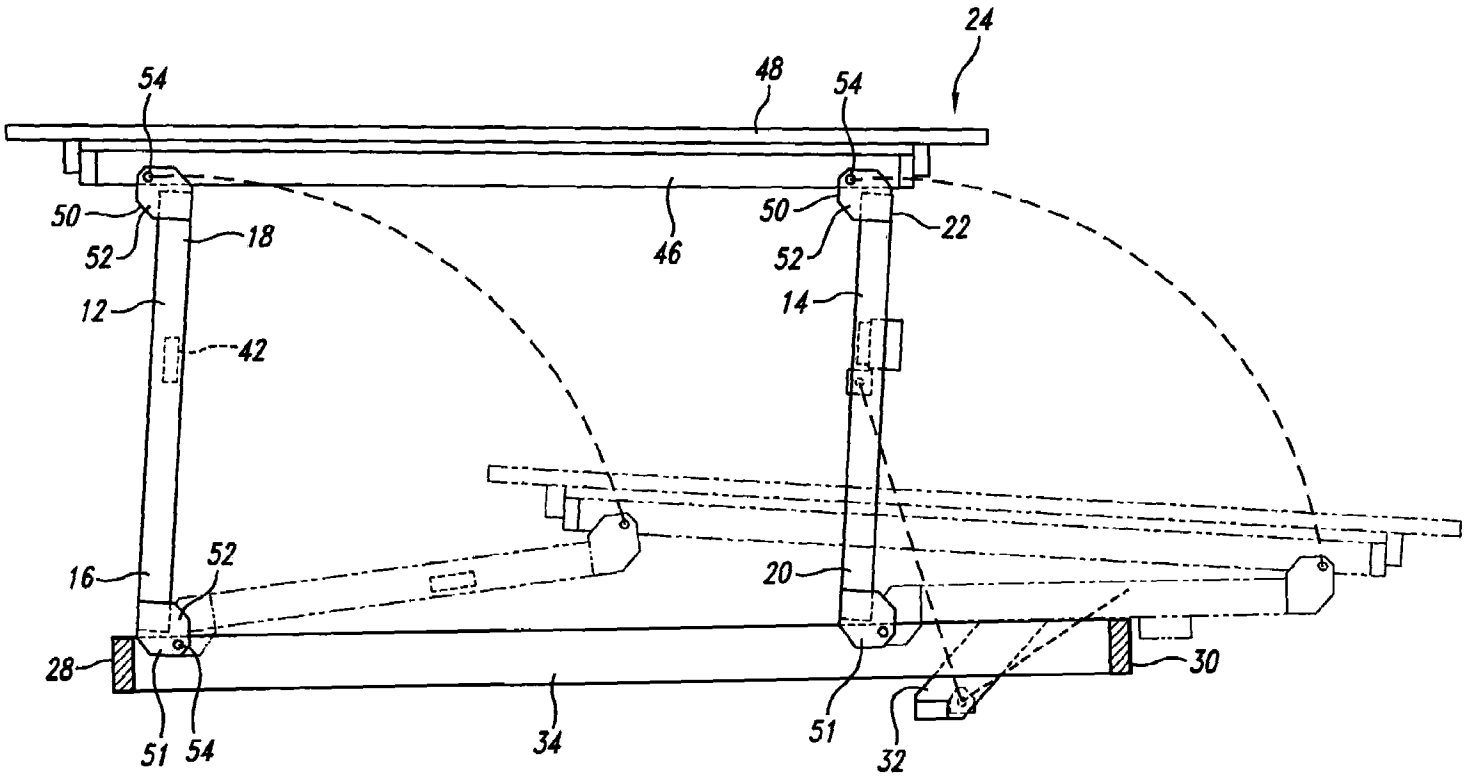
Fig. 2 (Prior Art)
FIG. 2 is a side elevational view of a watercraft lift moving between the "watercraft up" and "watercraft down" positions, according to the prior art.

A prior art watercraft lift is shown in FIGS. 1 and 2. As shown in FIG. 1, a watercraft lift includes a rectangular base 10 and forward and rear pairs of pivoting booms 12 and 14 with proximal and distal ends 16, 18 and 20, 22, respectively. The booms 12, 14 are rotatably attached at their proximal ends 16, 20 to the base 10 and rotatably attached at distal ends 18, 22 to a watercraft support platform 24. The support platform 24 is arranged to receive and support a watercraft (not shown). The lift further includes an actuation assembly 26 for pivoting the booms 12, 14 about their proximal end connections to the base. This action causes the booms, and hence the support platform and watercraft, to move between raised and lowered positions.

In more detail, still referring to FIG. 1, the base 10 includes a front transverse beam 28, a rear transverse beam 30, and an intermediate transverse beam 32 located therebetween. The transverse beams 28, 20, 32 are positioned parallel to one another and are connected to a pair of parallel longitudinal side beams 34. The front and rear transverse beams 28, 30 are horizontally oriented at one height, while the intermediate transverse beam 32 is oriented at a second, lower, height. The ends of the front and rear transverse beams extend laterally outward of the longitudinal side beams 34 and include upright sleeves 36. The sleeves 36 receive support posts 38 that include lower end shoes 40 capable of resting on the waterbody substrate. The posts 38 and sleeves 40 cooperate to enable an operator to adjust the watercraft support platform 24 to a desired height. The base members are preferably formed from a strong, lightweight, corrosion-resistant material. The forward booms 12 and the rear booms 14 are each pivotably connected to the longitudinal side beams 34 near the front and intermediate transverse beams 28 and 32, respectively. Forward and rear cross supports 42, 44 provide structural rigidity between the forward and rear pairs of booms 12, 14. The watercraft support platform 24 includes a pair of bunk beams 46 oriented parallel to the longitudinal side beams 34 and within the general upright plane of the forward and rear booms 12, 14. The bunk beams 46 are separated by a distance sufficient to safely cradle the hull of the boat. A cushioned bunk 48 is attached to the upper surface of each of the bunk beams 46 and is canted inward towards the other cushioned bunk. Other types of watercraft support platforms may be used to accommodate the multitude of watercraft variations in size and shape.

Still referring to FIG. 1, the boom distal ends 18, 22 are pivotally joined to the bunk beams 46 using offset pivot joints 50. The boom distal ends include a structural portion that is laterally offset forward from the longitudinal centerline of the boom. In this embodiment, the offset portion is formed from a pair of plates 52 welded to each boom distal end. The plates straddle the bunk beams 46, and are pivotably held to the beams by rotatable pins 54. The boom proximal ends 16, 20 are pivotably connected to the longitudinal side beams 34 in a similar manner using offset pivot joints 51. In going between raised and lowered positions, the booms 14, 16 pivot relative to the longitudinal side beams 34 and the bunk beams 46 about the offset pivot joints 50, 51. The raising and lowering of the lift is accomplished by the actuation assembly 26 in which one or more actuators 27 are pivotably connected between the intermediate transverse beam 32 and rear booms 14. The actuators 27 are preferably powered from an independent power supply unit 64.

Referring now to FIG. 2, to position a watercraft on the watercraft support platform 24, the lift is lowered to a lowered position at which its raised forward end is just under or at the water surface. The operator then drives the watercraft between the platform bunks 48 until the boat's bow contacts the bunks. The actuators 27 are extended to pivot the booms 12, 14 upward and forward about their proximal end connections provided by offset pivotal joints 50, 51. The watercraft support platform 24 follows accordingly, causing the watercraft to be fully lifted to a raised position, preferably fully out of the water. To lower a craft, the actuators 27 are retracted causing the booms 12, 14 to pass to their lowered position. In very shallow waters, it may not be possible to lower the watercraft support platform 24 sufficiently to allow the watercraft to be driven between and onto the platform bunks 48. The shallow water watercraft lift described below may be used to reduce friction between the watercraft support platform 24 and watercraft hull, and thereby allow for efficient and safe use of such a watercraft lift is such waters.

Figure 3:
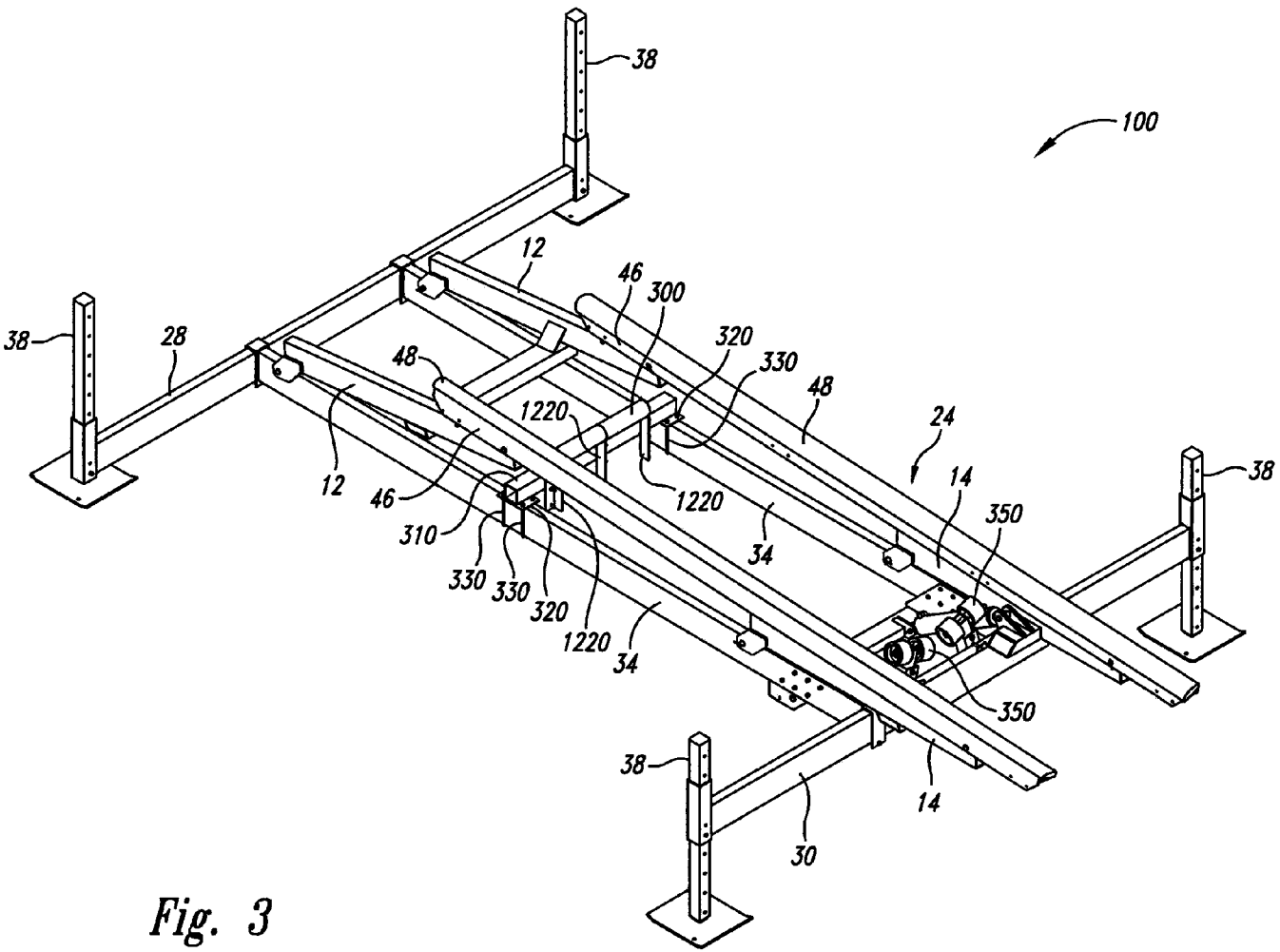
FIG. 3 is a rear isometric view of a watercraft lift in the "watercraft down" position incorporating a first embodiment of the present invention.

FIG. 3 illustrates an embodiment of a shallow water watercraft lift 100 of the invention shown utilizing the general translating bunk watercraft lift design described above, with the shallow water watercraft lift illustrated in the down or lowered position. For convenience and clarity, the reference numerals for the similar components of the prior art and the inventive lifts will not be repeated in FIGS. 3-12 except where such use is believed helpful. A front roller assembly 300 of the shallow water watercraft lift 100 is connected to a central cross beam 310 using three mounting brackets 1220 (shown in greater detail in FIG. 11). The central cross beam 310 is connected to the longitudinal side beams 34 with connection plates 320 and U-bolts 330. Two rear roller assemblies 350 are attached to the rear transverse beam 30 by offset bracket plates 885 (shown in FIGS. 4 and 8).

Figure 4:
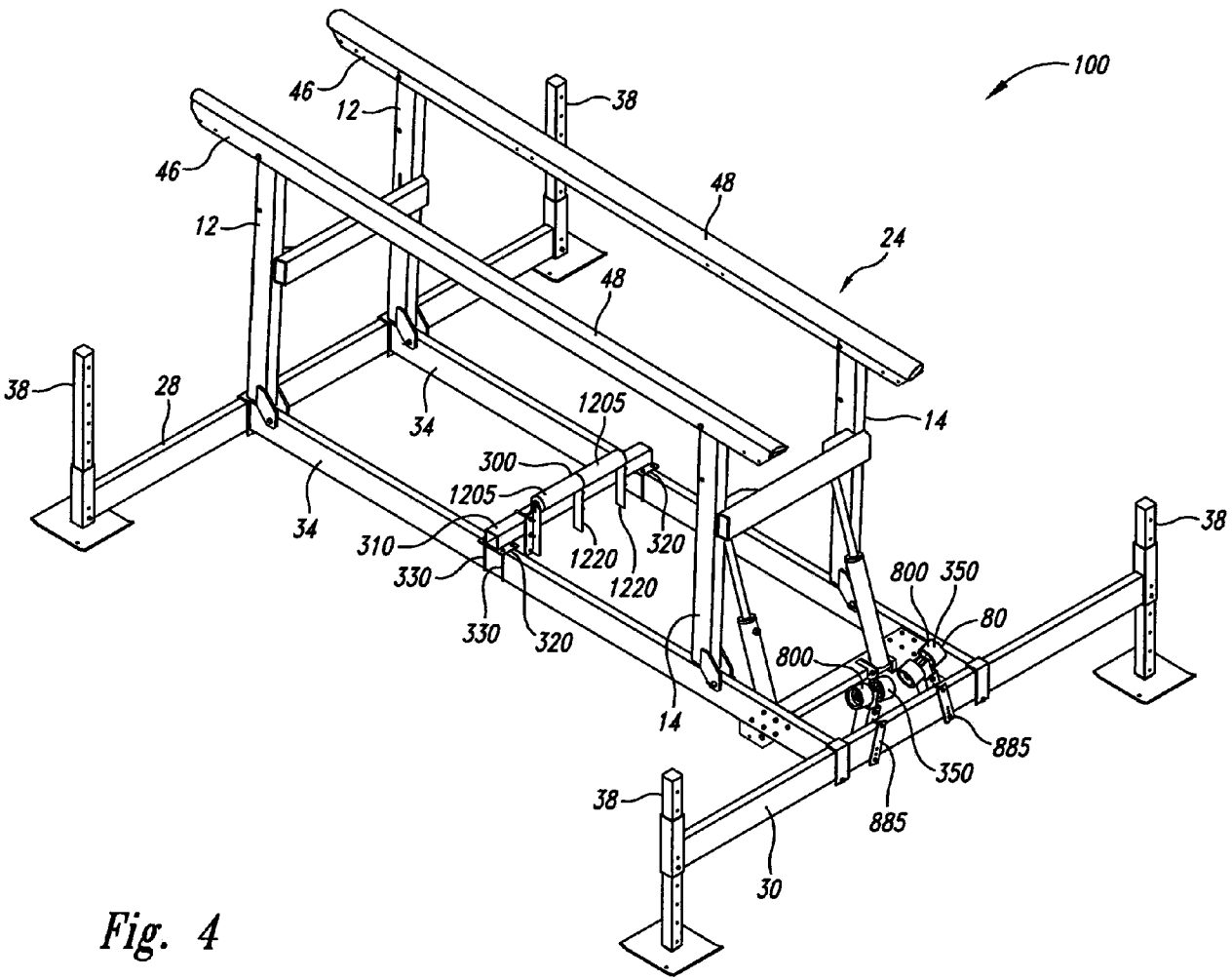
FIG. 4 is a rear isometric view of the watercraft lift of FIG. 3 in the "watercraft up" position.
Figure 5:
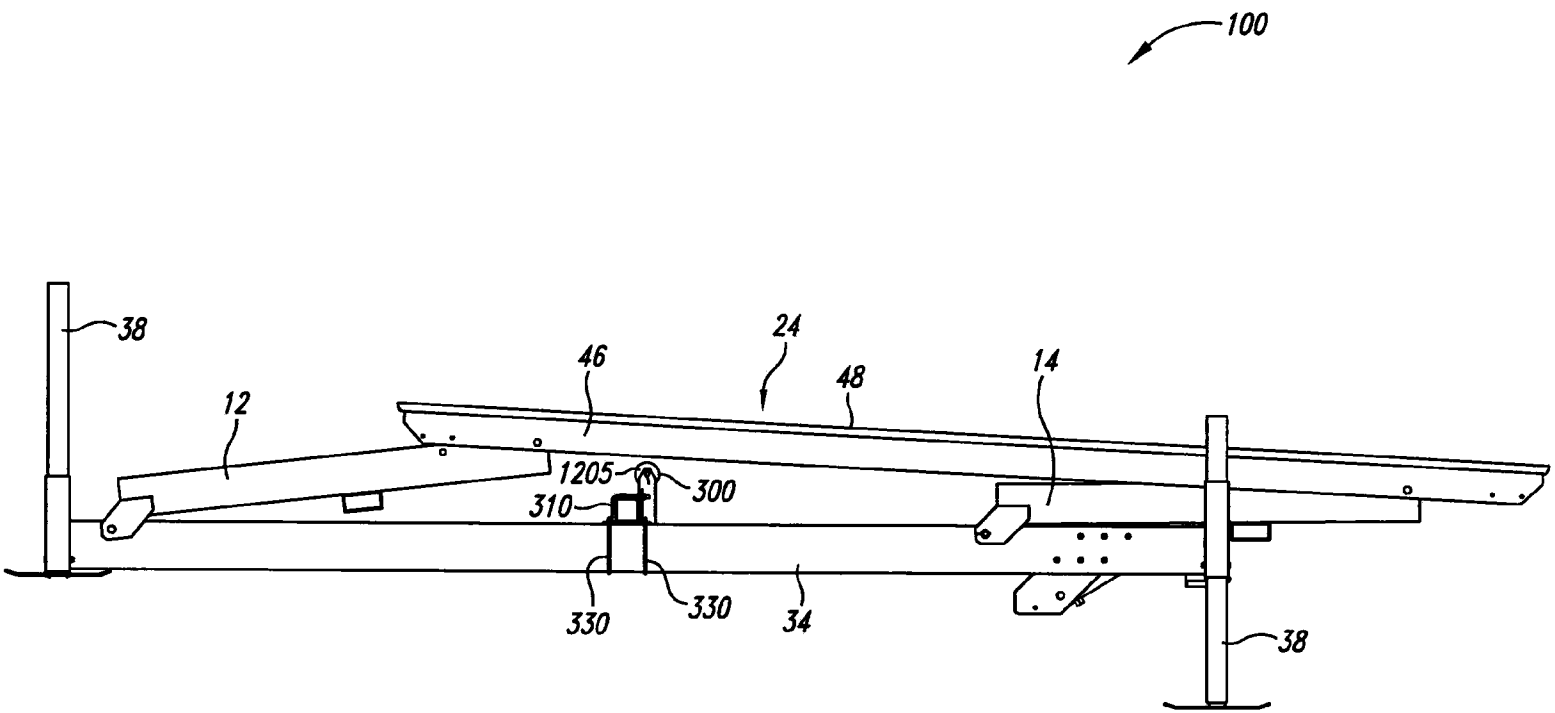
FIG. 5 is a side elevational view of the watercraft lift of FIG. 3 in the "watercraft down" position.

FIG. 4 shows the shallow water watercraft lift 100 in the up or raised position. FIG. 5 shows a side view of the shallow water watercraft lift 100 in the down position.

Figure 6:
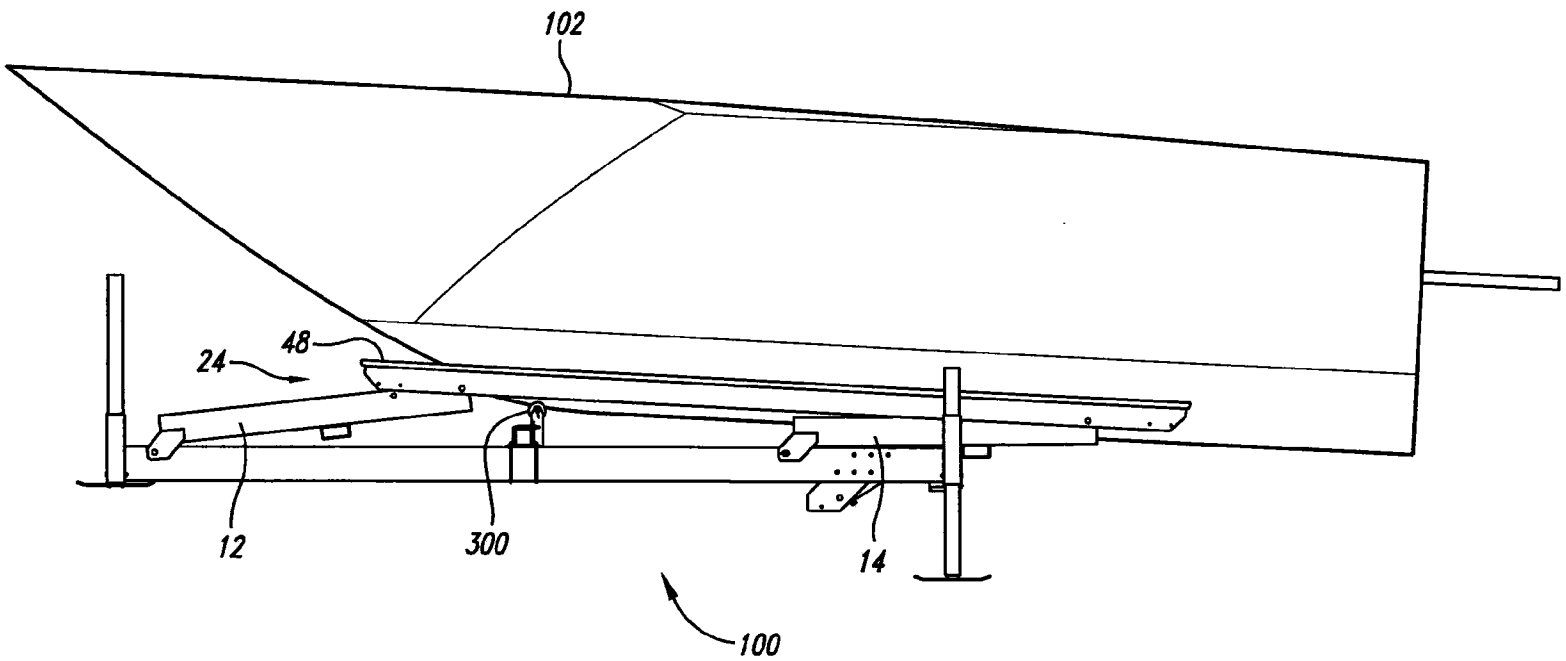
FIG. 6 is a side elevational view of the watercraft lift of FIG. 3 with a watercraft thereon in the "watercraft down" position and with all support posts fully retracted.

FIG. 6 shows a side view of the shallow water watercraft lift 100 in the down position and with a watercraft 102 supported on the bunks 48 of the watercraft support platform 24.

Figure 7:
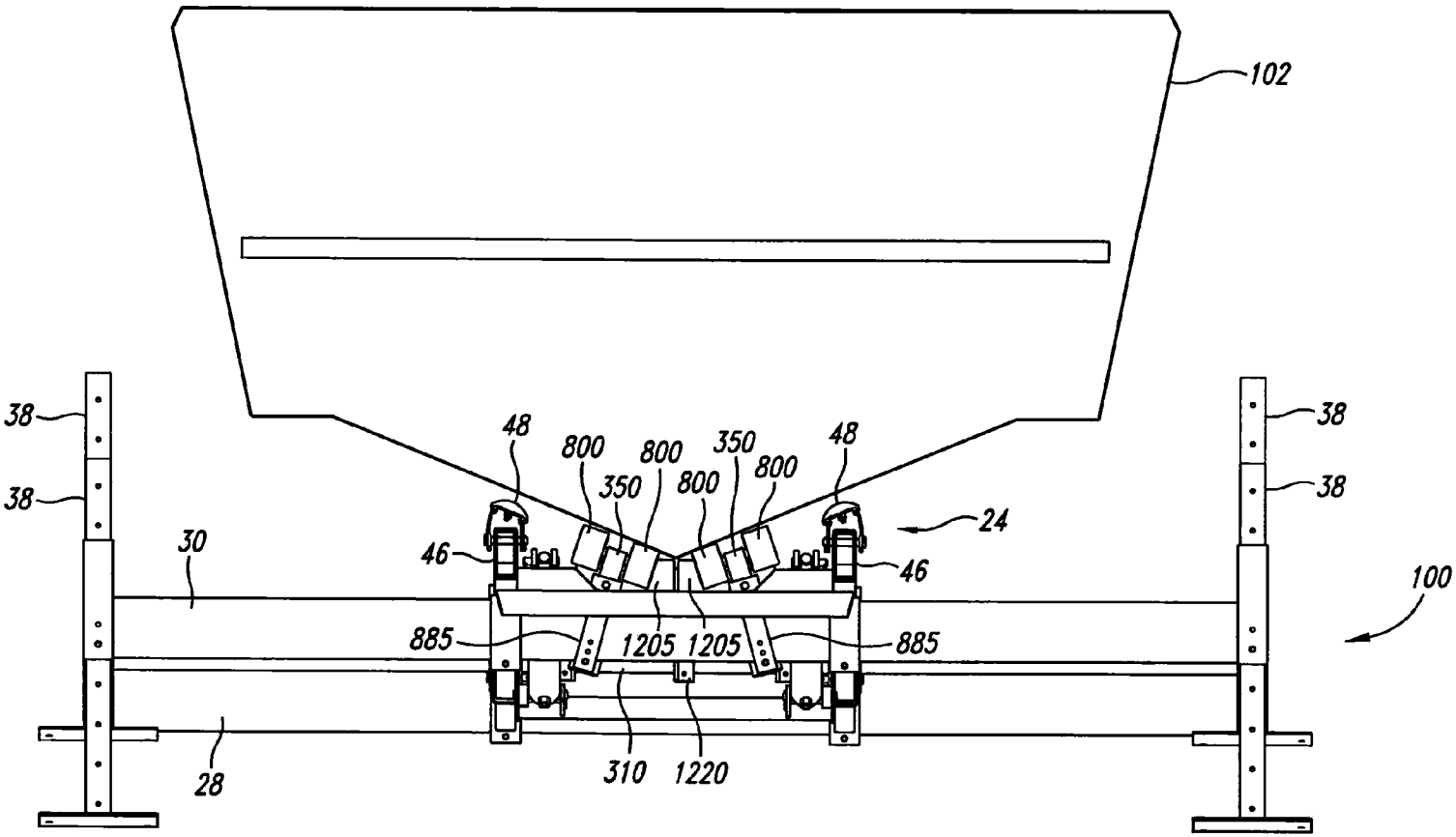
FIG. 7 is a rear elevational view of the watercraft lift of FIG. 3 with the watercraft thereon looking along the bunks.

FIG. 7 shows a rear view (looking along bunks 48) of the shallow water watercraft lift 100 in the down position and with the watercraft 102 supported by the rollers and positioned above the bunks 48.

Figure 8:
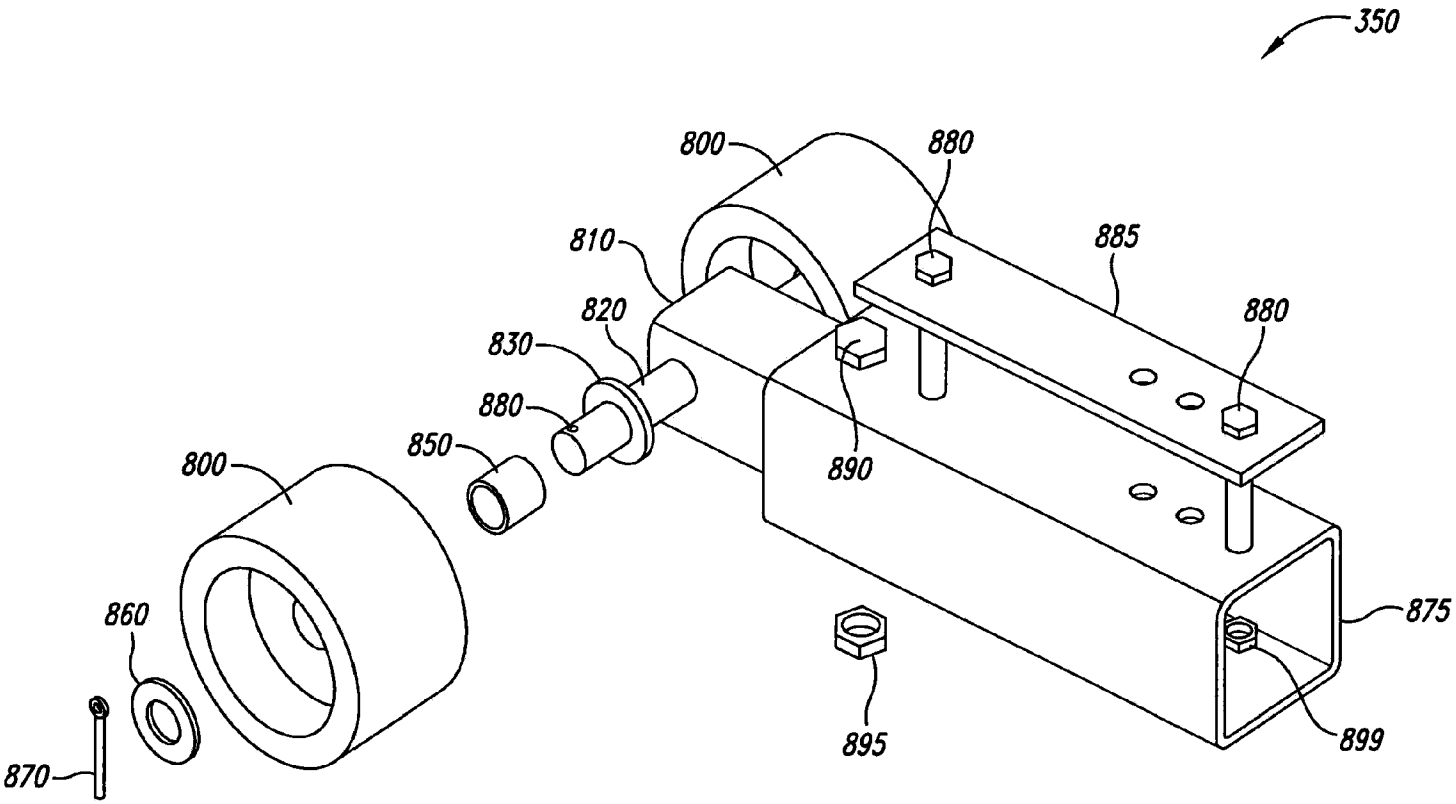
FIG. 8 is an enlarged isometric exploded view of a rear roller and bracket assembly of the watercraft lift of FIG. 3.

FIG. 8 shows an exploded view of the rear roller assembly 350. The rear roller assembly 350 includes two rotatable rollers 800, each approximately 5 inches in diameter and with a hole positioned in the center of the roller, positioned on both sides of a square, hollow tube 810 that includes holes to receive a headless shaft 820. The shaft 820 is approximately ½ inches in diameter or larger and approximately 6 inches long. When the rear roller assembly 350 is assembled, the shaft 820 extends through the holes in the hollow tube 810 with one end portion of the shaft extending through a central hole in one of the rollers 800 and the other end portion of the shaft extending through a central hole in the other one of the rollers 800. Each end portion of the shaft 820 has a washer 830 mounted on the shaft 820 adjacent to the hollow tube 810, and a spacer 850 mounted on the shaft outward thereof and adjacent to the roller 800. A washer 860 is mounted on the end portion of the shaft 820, outward of the wheel 800, and a cotter pin 870 is extends through a hole 878 toward the end of the end portion of shaft 820, outward of the washer 860 to secure the rollers on the shaft.

Still referring to FIG. 8, the hollow tube 810 is positioned within a larger hollow tube 875 and connected thereto by a bolt 890 which is secured by a nut 895. The hollow tube 810 is sufficiently smaller than the interior opening of the hollow tube 875 to allow limited pivoting motion of the hollow tube 810 on the bolt 890 relative to the hollow tube 875, thus providing limited pivotal movement of the rollers 800 to accommodate watercraft with differing v-hull angles. The illustrated embodiment provides about 3 inches of rock. The hollow tube 875 is clamped onto the rear transverse beam 30 using an offset bracket plate 885 which is attached to the hollow tube 875 by a pair of bolts 880 secured by nuts 899. The hollow tube 875 may be clamped to the rear transverse beam 30 at a lateral position selected to correspond to the watercraft 102 to be lifted by the shallow water watercraft lift 100. The hollow tube 875 and the offset bracket plate 885 are provided with a series of holes for the lower one of the bolts 880 to permit vertical adjustment of the position of the hollow tube 875 and hence the rollers 800 relative to the rear transverse beam 30.

As noted, the rear roller assembly 350 uses two rollers of approximately 5 inches in diameter with a 3 inch rocker. The rollers are similar to those sold by Stoltz Industries, Inc. under the trade name Super Rollers™.

Figure 9:
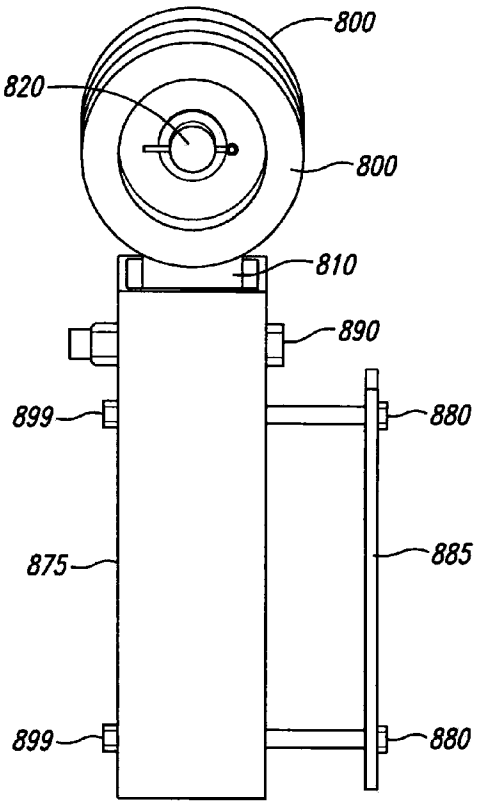
FIG. 9 is a side view of the rear roller and bracket assembly of FIG. 8.

FIG. 9 shows a side view of the rear roller assembly 350.

Figure 10:
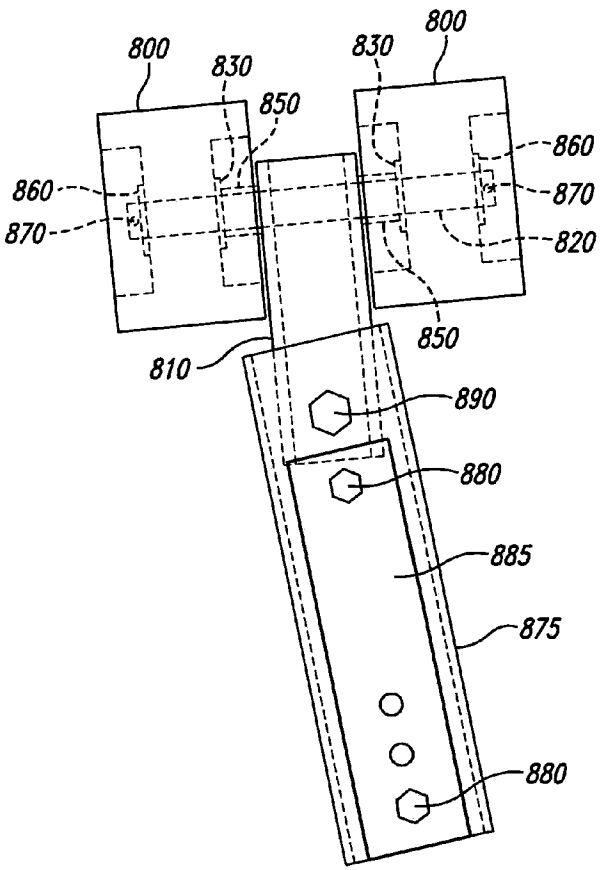
FIG. 10 is a rear elevational view of the rear roller and bracket assembly of FIG. 8.

FIG. 10 shows a rear view of the rear roller assembly 350.

Figure 11:
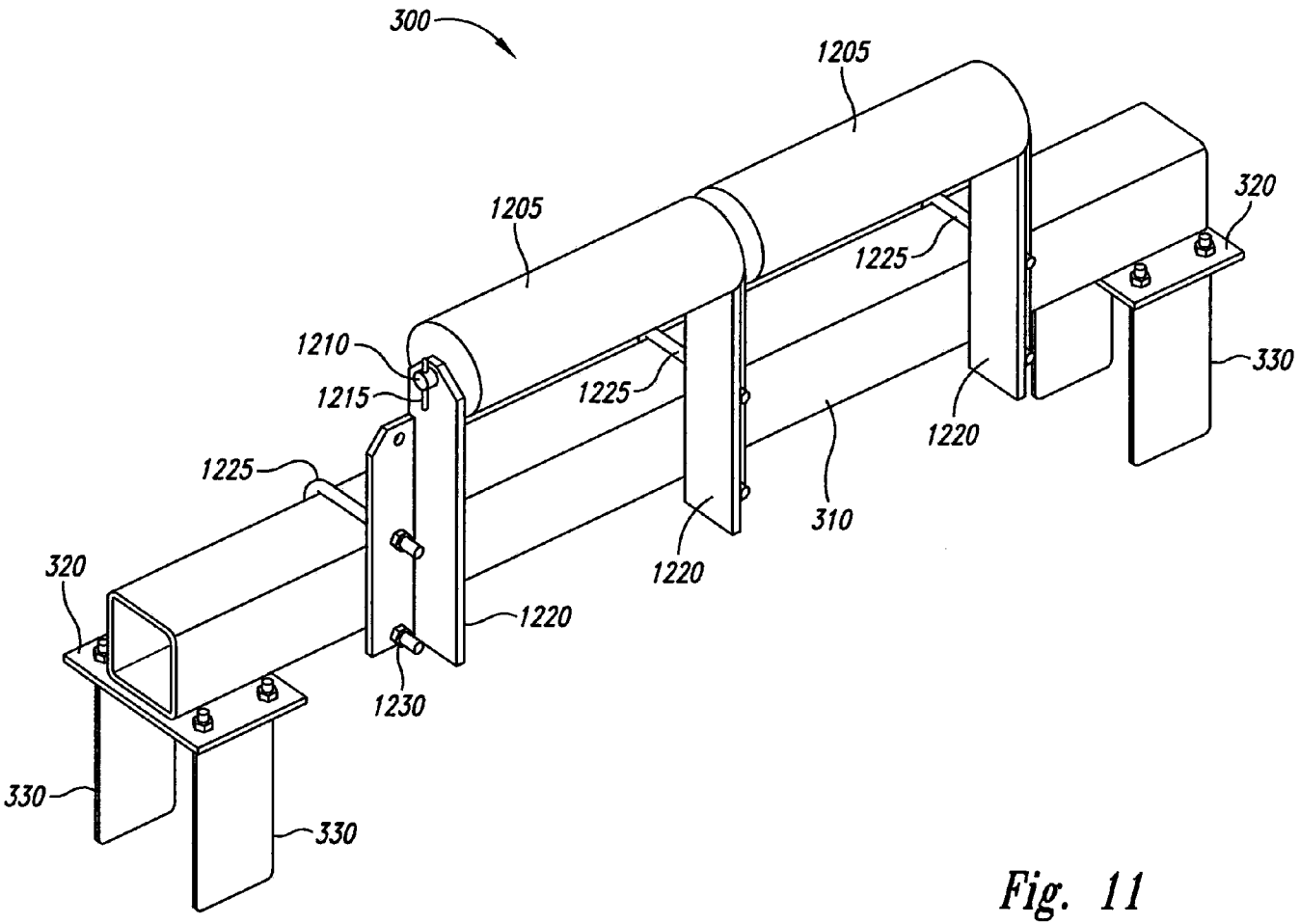
FIG. 11 is a rear isometric view of a front roller, bracket assembly, and cross beam connection assembly of the watercraft lift of FIG. 3.

FIG. 11 shows the forward roller assembly 300. The front roller assembly 300 includes of two coaxially mounted, rotatable cylindrical rollers 1205 for contacting the watercraft hull. This front roller assembly has been found more suitable for heavier watercraft. The forward roller assembly 300 uses one or more rollers 1205 approximately 5 inches in diameter. The two rollers 1205 are mounted on a shaft 1210 that extends through holes in three mounting brackets 1220. Each roller 1205 is positioned between a two of the mounting brackets 1220 and the shaft 1210 is secured in position by a cotter pin 1215 at each end outward of the outermost mounting bracket 1220. The mounting brackets 1220 are connected to the central cross beam 310 by U-bolts 1225 which are secured by nuts 1230. As described above, the central cross beam 310 is connected to the longitudinal side beams 34 by the connection plates 320 and the U-bolts 330 by clamping it to the central cross beam at a lateral position selected to correspond to the watercraft 102 to be lifted by the shallow water watercraft lift 100. The mounting brackets 1220 are provided with a series of holes for the U-bolts 1225 to permit vertical adjustment of the position of the mounting brackets 1220 and hence the rollers 1205 relative to the central cross beam 310.

Figure 12:
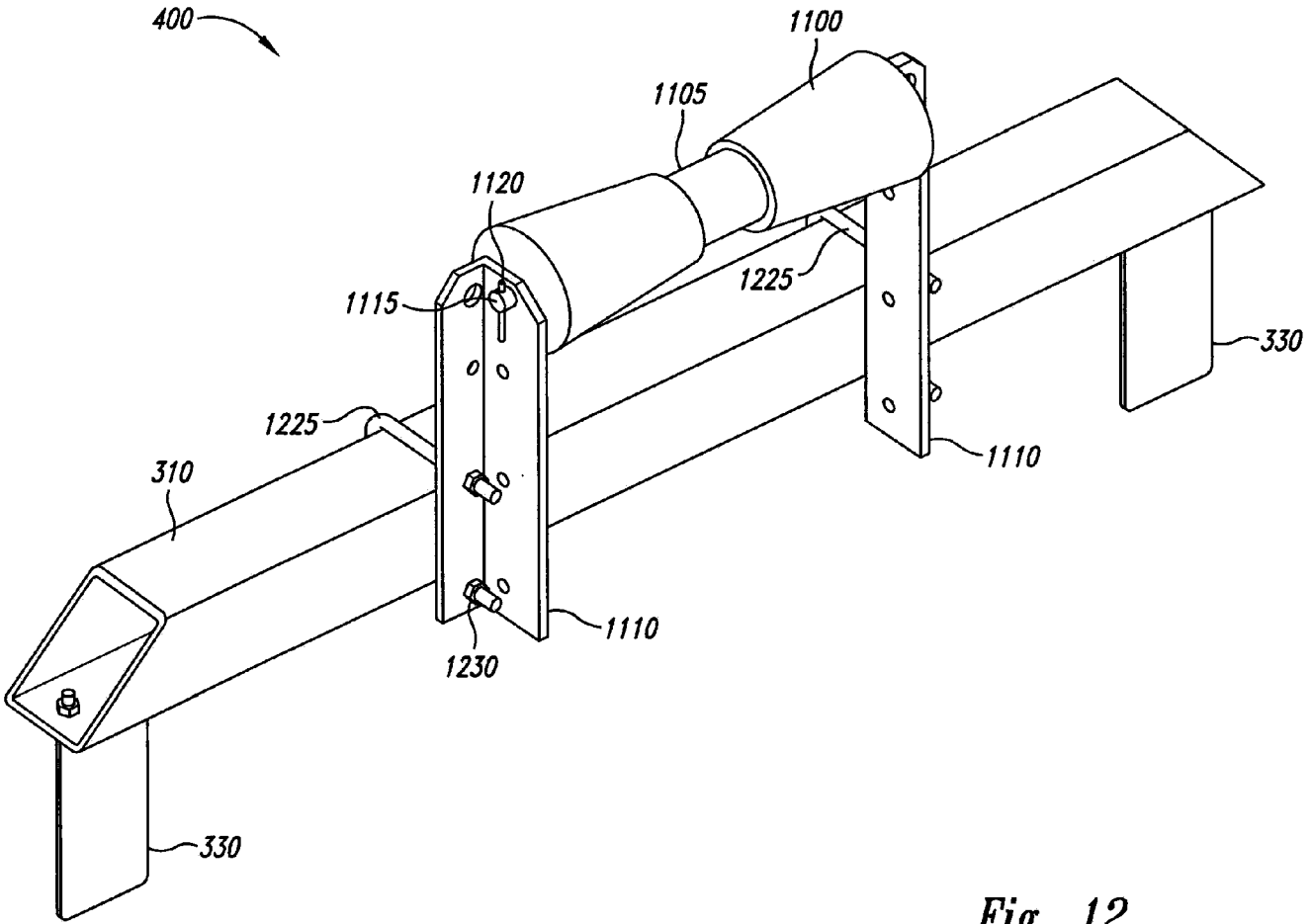
FIG. 12 is a rear isometric view of an alternative front roller, bracket assembly, and cross beam connection assembly usable with the watercraft lift of FIG. 3.

FIG. 12 shows an alternative front roller assembly 400. The front roller assembly 400 includes a tapered roller 1100 that tapers inwardly and downwardly from both ends towards a central reduced diameter portion 1105. The roller 1100 is approximately 12 inches long and mounted on a shaft 1115 approximately 13 inches long. The roller 1100 is positioned between two mounting brackets 1110 and the shaft 1115 is secured in position by a cotter pin 1120 at each end outward of the mounting bracket. As described above, the mounting brackets 1110 are connectable to the central cross beam 310 by U-bolts 1225. The central cross beam in this embodiment is attachable to the longitudinal side beams 34 by a single U-bolt 330 without the use of a connection plate.

The shallow water watercraft lift 100 has the front roller assembly 300 and the rear roller assemblies 350 arranged at heights relative to the bunks 48 when in their lowered position such that when the watercraft 102 is driven onto the lift and the watercraft engages the front and rear roller assemblies, the front and rear roller assemblies raise the watercraft to a partially lifted elevation above the elevational level of the watercraft that would be achieved if resting on the bunks. In the illustrated embodiment the roller assemblies are positioned to support the watercraft approximately 1 to 2 inches above the bunks 48 when in their lowered position, and when on the roller assemblies in a stable, generally horizontal position so that the watercraft will stay on the roller assemblies for subsequent lifting by the bunks without being secured to the lift. The illustrated front and rear roller assemblies 300 and 350 are vertically adjustable in height when installed but during use are non-extendible with a substantially fixed vertical height except for the slight height change that may result from the limited pivotal movement of the hollow tube 810 within the larger hollow tube 875 provided to accommodate watercraft with differing v-hull angles. The watercraft 102 is lifted as a result of the forward drive force of the watercraft or the pulling or pushing of the watercraft forward by other means, such as the watercraft engages the roller assemblies it moves upward and passes over the roller assemblies which remain essentially vertically stationary relative to the beams to which connected.

In the embodiment described, the front roller assembly 300 and the rear roller assemblies 350 are connected to the central cross beam 310 and the rear transverse beam 30, however, the roller assemblies may be connect to other ones of the frame portions of the base or to the lifting booms 12, 14.

When operated in water that would be too shallow for the watercraft to be driven directly onto the bunks 48 if the lift did not include the front and rear roller assemblies, the partially lifted elevation to which the front and rear roller assemblies 300 and 350 raise the watercraft is above the elevational level of the watercraft when floating in the water prior to being driven onto the lift. The operation of the front and rear roller assemblies 300 and 350 also positions the watercraft at or above the bunks for subsequent lifting by the bunks.

In the embodiment described, the front roller assembly 300 and the rear roller assemblies 350 may be arranged to provide an initial partially lifted elevation from 6 to 12 inches. With this arrangement, the shallow water watercraft lift 100 can be operated in water with a water level below the level at which the bunks 48, without the initial lifting assistance of the front and rear roller assemblies 300 and 350, could properly operated by themselves. In other words, by using front and rear roller assemblies that initially lift the watercraft 102 by an initial amount, such as the 6 to 12 inches noted, the shallow water watercraft lift 100 can operate in water that is 6 to 12 inches too shallow for operation using the bunks 48 by themselves. The front roller assembly 300 and the rear roller assemblies 350 essential provide an initial lift up of the watercraft 102 to a level preferably at or above a level sufficient for the bunks 48 to engage the watercraft 102 when moved upward from their lowered position. After the watercraft is initially lifted by the roller assemblies by an amount sufficient to position the watercraft over the bunks 48, the bunks can then be raised to engage and lift the watercraft off of the roller assemblies 300 and 350, and upward to a raised position, preferably fully out of the water. This initial and then subsequent lifting of the shallow water watercraft lift 100 can be accomplished without the need to secure the watercraft 102 to the lift to prevent it from being accidentally re-launched after the initial lifting and without the watercraft experiencing an angular orientation while being lifted, initially and subsequently, so large relative to the waterline as to be undesirable to a user driving the watercraft onto the lift.

Of course, the shallow water watercraft lift 100 can lower the watercraft 102 can be lowered from the raised position for re-launching the watercraft by lowering the bunks 48 to the lowered position, and then driving the watercraft off of the lift, which is generally the reverse of the procedure used to bunk the watercraft.

In the embodiment described, the front roller assembly 300 and the rear roller assemblies 350 are arranged to preferably be under the water during usage. Since the roller assemblies need only provide a limited amount of initial lift of the watercraft 102 relative to the bunks 48, and are not used to raise the watercraft the full lifting range of the lift, the roller assemblies of the shallow water watercraft lift 100 can be submerged and yet the lift will still provide sufficient lift to raise the watercraft substantially above the water with the watercraft 102 during the entire lifting process remaining relatively horizontal relative to the waterline.

Other initial lifting device can be used with or in replacement of the front and rear roller assemblies 300 and 350 such as slide boards to provide the described initial lift of the watercraft.

It will be appreciated that, although specific embodiments of the invention have been described herein for purposes of illustration, various modifications may be made without departing from the spirit or scope of the invention.

I claim:

1. A watercraft lift for lifting a watercraft upward, comprising:

a freestanding frame having a front end and a rear end, and having a plurality of legs;

translating bunks movably connected to the frame and movable between a lowered translating bunk position and a raised translating bunk position, the translating bunks being arranged to engage and lift the watercraft when positioned thereon between a lower watercraft position and the raised translating bunk position; and at least one watercraft initial lift member positioned to engage and lift the watercraft to the lower watercraft position as the watercraft is moved into engagement therewith and toward one of the front and rear ends of the frame, the watercraft initial lift member being arranged to permit positioning of the watercraft for engagement by the translating bunks for lifting of the watercraft off of the watercraft initial lift member between the lower watercraft position and the raised translating bunk position.

2. The watercraft lift of claim 1, wherein the watercraft initial lift member is attached to the frame of the watercraft lift.

3. The watercraft lift of claim 1, wherein the watercraft initial lift member includes at least one roller.

4. The watercraft lift of claim 1, wherein the watercraft initial lift member includes at least one rear initial lift member toward the rear end of the frame, and at least one initial front lift member located forward of the rear initial lift member.

5. The watercraft lift of claim 4, wherein the rear initial lift member is pivotable to match the angle of a portion of a hull of the watercraft.

6. The watercraft lift of claim 1, wherein the watercraft initial lift member is adjustable in height.

7. The watercraft lift of claim 1, wherein the watercraft initial lift member is adjustable laterally.

8. The watercraft lift of claim 1, wherein the frame has at least two legs toward the front end of the frame, and at least two legs toward the rear end of the frame.

9. The watercraft lift of claim 1, wherein the frame has a substantially rectangular base including first and second spaced apart longitudinal side beams and front and rear cross beams, and the translating bunks include first and second bunks for engaging the watercraft, with the first bunk pivotally connected to a first set of forward and rear booms pivotally connected to the first side beam and with the second bunk pivotally connected to a second set of forward and rear booms pivotally connected to the second side beam.

10. The watercraft lift of claim 9, further including at least one hydraulic actuator arranged to rotate the booms.

11. The watercraft lift of claim 1, wherein the watercraft initial lift member includes at least one rear roller positioned toward the rear end of the frame, and at least one front roller positioned forward of the rear roller.

12. A watercraft lift for lifting a watercraft upward, comprising:

a translating watercraft support movable between a lowered translating support position and a raised translating support position, the translating watercraft support being arranged to engage and lift the watercraft when positioned thereon between a lower watercraft position and the raised translating support position; and at least one non-extendible watercraft initial lift member positioned to engage and lift the watercraft to the lower watercraft position as the watercraft is moved into engagement therewith and into position over the translating watercraft support, the watercraft initial lift member being arranged to permit positioning of the watercraft for engagement by the translating watercraft support for lifting of the watercraft off of the watercraft initial lift member between the lower watercraft position and the raised translating bunk position.

13. The watercraft lift of claim 12, wherein the lower watercraft position is at or above the lowered translating support position of the translating watercraft support and below the raised translating support position.

14. The watercraft lift of claim 12, wherein the at least one watercraft initial lift member includes a first watercraft initial lift member positioned to first engage and lift the watercraft upon the watercraft first being moved onto the lift, and a second watercraft lift member positioned spaced apart from the first watercraft initial lift member to engage the watercraft after the watercraft is first engaged by the first watercraft initial lift member, the first and second watercraft initial lift members being arranged to support the watercraft positioned fully thereon in a stable position without requiring securing of the watercraft to the lift.

15. The watercraft lift of claim 12, further including a freestanding frame, and wherein the translating watercraft support is movably connected to the frame, and watercraft initial lift member is supported by the frame.

16. The watercraft lift of claim 15, wherein the translating watercraft support includes first and second watercraft engagement members for engaging the watercraft, and first and second booms pivotally connected to the frame, the first boom supporting the first watercraft engagement member and the second boom supporting the second watercraft engagement member.

17. The watercraft lift of claim 16, further including at least one hydraulic actuator arranged to rotate the first and second booms.

18. A watercraft lift for lifting a watercraft upward, the watercraft having a first watercraft elevational position when floating in the water prior to engagement with the lift, comprising:

a translating watercraft support movable between a lowered translating support position and a raised translating support position, the translating watercraft support being arranged to engage and lift the watercraft when positioned thereon; and at least one watercraft initial lift member positioned to engage and lift the watercraft to a second watercraft elevational position higher than the first watercraft elevational position as the watercraft is moved into engagement therewith and into a position over the translating watercraft support permitting lifting by the translating watercraft support when in the lowered translating support position, the translating watercraft support being arranged to lift the watercraft off of the watercraft initial lift member and move the watercraft upward to a third watercraft elevational position higher than the second watercraft elevational position as the translating watercraft support moves upward from the lowered translating support position to the raised translating bunk position.

19. A watercraft lift for lifting a watercraft upward, the watercraft having a first watercraft elevational position when floating in the water prior to engagement with the lift, comprising:

a watercraft initial lift positioned to engage and lift the watercraft to a second watercraft elevational position higher than the first watercraft elevational position as the watercraft is moved into engagement therewith and into a position supported by the watercraft initial lift;

a translating watercraft support movable between a lowered translating support position and a raised translating support position, the translating watercraft support being arranged to engage and lift the watercraft when in the position supported by the watercraft initial lift off of the watercraft initial lift and to a third watercraft elevational position higher than the second watercraft elevational position as the translating watercraft support moves upward to the raised translating bunk position.

20. The watercraft lift of claim 19, wherein the watercraft initial lift includes a first watercraft initial lift member positioned to first engage and lift the watercraft upon the watercraft first being moved onto the lift, and a second watercraft lift member positioned spaced apart from the first watercraft initial lift member to engage the watercraft after the watercraft is first engaged by the first watercraft initial lift member, the first and second watercraft initial lift members being arranged to support the watercraft positioned thereon at the second watercraft elevational position without requiring securing of the watercraft to the lift.

21. A watercraft lift for lifting a watercraft upward, comprising:

a freestanding frame;

first and second translating bunks spaced apart in a first direction, the translating bunks being movably connected to the frame and movable between a lowered translating bunk position and a raised translating bunk position, the translating bunks being arranged to engage and lift the watercraft when positioned thereon between a lower watercraft position and the raised translating bunk position; and a plurality of watercraft initial lift members positioned to engage and lift the watercraft to the lower watercraft position as the watercraft is moved into engagement therewith and into position over the translating bunks, the watercraft initial lift members being arranged to permit positioning of the watercraft for engagement by the translating bunks for lifting of the watercraft off of the watercraft initial lift members between the lower watercraft position and the raised translating bunk position, the lower watercraft position being above the lowered translating bunk position of the translating bunks and below the raised translating bunk position.

22. The watercraft lift of claim 21, wherein the first translating bunk is connected to at least one pivotable first boom for moving the first translating bunk between the lowered translating bunk position and the raised translating bunk position, and the second translating bunk is connected to at least one pivotable second boom for moving the first translating bunk between the lowered translating bunk position and the raised translating bunk position.

23. The watercraft lift of claim 21, wherein the watercraft initial lift members include at least first and second rollers spaced apart in a second direction transverse to the first direction.

24. The watercraft lift of claim 23, wherein the first and second rollers are positioned to be submerged below the water when the watercraft lift is in use.

25. A method of bunking a watercraft in position above the water using a watercraft lift, the watercraft having a first watercraft elevational position when floating in the water prior to engagement with the lift, comprising:

providing a translating watercraft support sized to support the watercraft thereon;

providing a watercraft initial lift positioned to engage and lift the watercraft to a second watercraft elevational position higher than the first watercraft elevational position as the watercraft is moved into engagement therewith and into position over the translating watercraft support for lifting by the translating watercraft support;

first moving the watercraft into engagement with the watercraft initial lift in a manner to lift the watercraft to the second watercraft elevational position and to position the watercraft above the translating watercraft support;

second upwardly moving the translating watercraft support to lift the watercraft upward off of the watercraft initial lift; and third upwardly moving the translating watercraft support to a third watercraft elevational position higher than the second watercraft elevational position.

26. A method of bunking a watercraft in a position above the water using a watercraft lift where the watercraft has a first watercraft elevational position when floating in the water prior to engagement with the lift, the lift having a translating watercraft support sized to support the watercraft thereon and a watercraft initial lift positioned to engage and lift the watercraft as the watercraft is moved into engagement therewith and into position over the translating watercraft support for lifting by the translating watercraft support, comprising:

first driving the watercraft into engagement with the watercraft initial lift with sufficient force to lift the watercraft to a second watercraft elevational position higher than the first watercraft elevational position and position the watercraft for engagement with the translating watercraft support;

second moving the translating watercraft support upward from a lowered translating support position to lift the watercraft upward off of the watercraft initial lift; and third moving the translating watercraft support further upward to a raised translating support position whereat the watercraft is in a third watercraft elevational position higher than the second watercraft elevational position.

27. A method of converting an existing watercraft lift usable to lift a watercraft in water of a first minimum depth to a modified watercraft lift usable to lift the watercraft in water of a second minimum depth less than the first minimum depth, where the watercraft has a first watercraft elevational position when floating in the water prior to engagement with the lift and where the watercraft lift being converted has a translating watercraft support sized to support the watercraft thereon and movable between a lowered translating support position and a raised translating support position, comprising:

providing at least one watercraft initial lift; and attaching the watercraft initial lift to the existing watercraft lift in position to be engaged by and lift the watercraft to a second watercraft elevational position higher than the first watercraft elevational position as the watercraft is moved into engagement therewith and over the translating watercraft support for engagement thereby for lifting of the watercraft off of the watercraft initial lift as the translating watercraft support is moved upward from the lowered translating bunk position to the raised translating bunk position whereat the watercraft is in a third watercraft elevational position higher than the second watercraft elevational position.

28. The method of converting of claim 27, wherein the watercraft initial lift includes first and second watercraft initial lift members, and attaching the watercraft initial lift includes attaching the first watercraft initial lift member in a position to first engage and lift the watercraft upon the watercraft first being moved onto the lift, and attaching the second watercraft lift member in a position spaced apart from the first watercraft initial lift member to engage the watercraft after the watercraft is first engaged by the first watercraft initial lift member, with the first and second watercraft initial lift members being arranged to support the watercraft positioned thereon at the second watercraft elevational position without requiring securing of the watercraft to the lift.

29. A watercraft lift for lifting a watercraft upward, comprising:

a freestanding frame having a front end and a rear end, and having a plurality of legs;

translating bunks movably connected to the frame and movable between a lowered translating bunk position and a raised translating bunk position, the translating bunks being arranged to engage and lift the watercraft when positioned thereon between a lower watercraft position and the raised translating bunk position; and at least one watercraft initial lift member positioned to engage and lift the watercraft to the lower watercraft position as the watercraft is moved into engagement therewith and toward one of the front and rear ends of the frame, the watercraft initial lift member being arranged to permit positioning of the watercraft for engagement by the translating bunks for lifting of the watercraft off of the watercraft initial lift member between the lower watercraft position and the raised translating bunk position, the lower watercraft position being above the lowered translating bunk position of the translating bunks and below the raised translating bunk position.

* * * * *